US006485372B2

(12) United States Patent
Stuart et al.

(10) Patent No.: US 6,485,372 B2
(45) **Date of Patent: *Nov. 26, 2002**

(54) WATERSLIDE AND WATERSLIDE BOWL

(75) Inventors: Alexander Stuart, New Haven (GB); David J. Cuttell, New Haven (GB)

(73) Assignee: Whitewater West Industries Ltd., Richmond (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/028,246

(22) Filed: Dec. 19, 2001

(65) Prior Publication Data

US 2002/0077187 A1 Jun. 20, 2002

Related U.S. Application Data

(63) Continuation of application No. 09/747,486, filed on Dec. 20, 2000, now Pat. No. 6,354,955.

(51) Int. Cl.[7] ..... A63G 21/18

(52) U.S. Cl. ..... 472/117; 472/128

(58) Field of Search ..... 472/116, 117, 472/128, 13, 82; 104/53, 69, 70; 4/488, 494

(56) References Cited

U.S. PATENT DOCUMENTS

| | | | | |
|---|---|---|---|---|
| 419,860 A | | 1/1890 | Libbey | |
| 654,980 A | * | 7/1900 | Howard | 472/117 |
| 1,279,911 A | | 9/1918 | Ridgway | |
| 1,520,217 A | | 12/1924 | Auperl | |
| 1,577,689 A | | 3/1926 | Capitelli | |
| 1,648,196 A | | 11/1927 | Rohmer | |
| 2,724,123 A | * | 11/1955 | Kesler | 135/96 |
| 2,806,697 A | | 9/1957 | Huhn et al. | |
| 3,853,067 A | | 12/1974 | Bacon | |
| 3,923,301 A | | 12/1975 | Myers | |
| 4,149,710 A | * | 4/1979 | Rouchard | 104/70 |
| 4,194,733 A | | 3/1980 | Whitehouse, Jr. | |
| 4,196,900 A | | 4/1980 | Becker et al. | |
| 4,198,043 A | | 4/1980 | Timbes et al. | |
| 4,278,247 A | | 7/1981 | Joppe et al. | |
| 4,392,434 A | | 7/1983 | Dürwald et al. | |
| 4,805,897 A | | 2/1989 | Dubeta | |
| 4,836,521 A | * | 6/1989 | Barber | 104/86 |
| 4,905,326 A | * | 3/1990 | Nakamura et al. | 4/488 |
| 4,971,314 A | | 11/1990 | Barber | |
| 5,011,134 A | | 4/1991 | Langford | |
| 5,069,443 A | | 12/1991 | Shiratori | |
| 5,137,497 A | | 8/1992 | Dubeta | |
| 5,401,117 A | | 3/1995 | Lochtefeld | |
| 5,433,671 A | | 7/1995 | Davis | |
| 5,667,445 A | | 9/1997 | Lochtefeld | |
| 5,716,282 A | | 2/1998 | Ring et al. | |
| 5,738,590 A | | 4/1998 | Lochtefeld | |
| 5,766,082 A | | 6/1998 | Lochtefeld et al. | |
| 5,779,553 A | | 7/1998 | Langford | |
| 6,045,449 A | | 4/2000 | Aragona et al. | |
| 6,354,955 B1 | | 3/2002 | Stuart et al. | |

FOREIGN PATENT DOCUMENTS

| | | |
|---|---|---|
| GB | 2 224 948 A | 5/1990 |

* cited by examiner

*Primary Examiner*—Kien T. Nguyen
(74) *Attorney, Agent, or Firm*—Christensen O'Connor Johnson Kindness PLLC

(57) ABSTRACT

A waterslide bowl element has a bottom wall configured to form a throat around a rider exit opening in the bottom of the bowl. The bowl holds an annular ring of water around the throat that slows down and conducts the rider to the exit opening and a flume in which the waterslide ride continues. The waterslide bowl may be used by riders on inner tubes.

8 Claims, 3 Drawing Sheets

WATERSLIDE AND WATERSLIDE BOWL

CROSS-REFERENCE TO RELATED APPLICATION

This application is a continuation of our application No. 09/747,486, filed on Dec. 20, 2000, for WATERSLIDE BOWL, now U.S. Pat. No. 6,354,955.

BACKGROUND

1. Technical Field

This invention pertains to waterslides, and, more particularly, to a waterslide with a bowl element having a rider exit structure that permits the rider to continue the waterslide ride.

2. Background of the Invention

Waterslides typically provide for a rider, i.e. a user, to descend a flume, which may be a tube or open channel, sliding on the wetted surface of the flume or supported, partly or wholly, on water flowing down the flume. The ride is achieved under the influence of gravity and ends in a pool of water, or other safe landing structure. The rider may ride the waterslide with or without a mat, plastic sheet, inner tube or the like which provides some protection and facilitates sliding.

It is know to provide a bowl element as part of a waterslide apparatus. Including a bowl in a waterslide adds interest and excitement to the ride. GB 2,224,948 (Stuart et. al.) published May 23, 1990, discloses a waterslide bowl which a rider enters through a flume and exits by dropping through a hole in the bottom into a pool. However, since the rider drops out of the bowl into a pool of water, or onto another soft landing structure, the ride is ended at that point. The rider cannot ride on an inner tube on this type of slide, since he or she is not maintained in an upright position when falling out of the bowl and into the pool

SUMMARY OF THE INVENTION

It is an object of the invention to provide a bowl element for a waterslide ride which has a rider exit structure which permits the rider to exit in a controlled manner such that the water ride can continue, as in a flume leading down from the bowl.

It is a further object of the invention to provide a waterslide bowl having a ring of water at its bottom for slowing down riders.

It is a further object to provide a waterslide bowl in which a rider can ride either with or without an inner tube or other flotation device.

To accomplish these objects, the invention provides a waterslide bowl having a bottom wall portion that is configured to hold a ring of water around a rider exit opening. The bottom wall is shaped to form a throat structure around the rider exit opening which maintains a volume of water around the exit opening and is adapted to permit the rider, with or without an inner tube or other flotation device, to ride out of the bowl and into a flume which continues the water ride.

The waterslide bowl of the invention is one element in a waterslide ride apparatus. Such apparatus includes a flume leading into the bowl, a flume leading out of the bowl, and it may include other upstream and downstream elements, depending on the design choices made for a particular application.

These and other features of the invention will be apparent from the following description and drawings of the preferred embodiment.

DESCRIPTION OF THE PREFERRED EMBODIMENT

Figure 1:
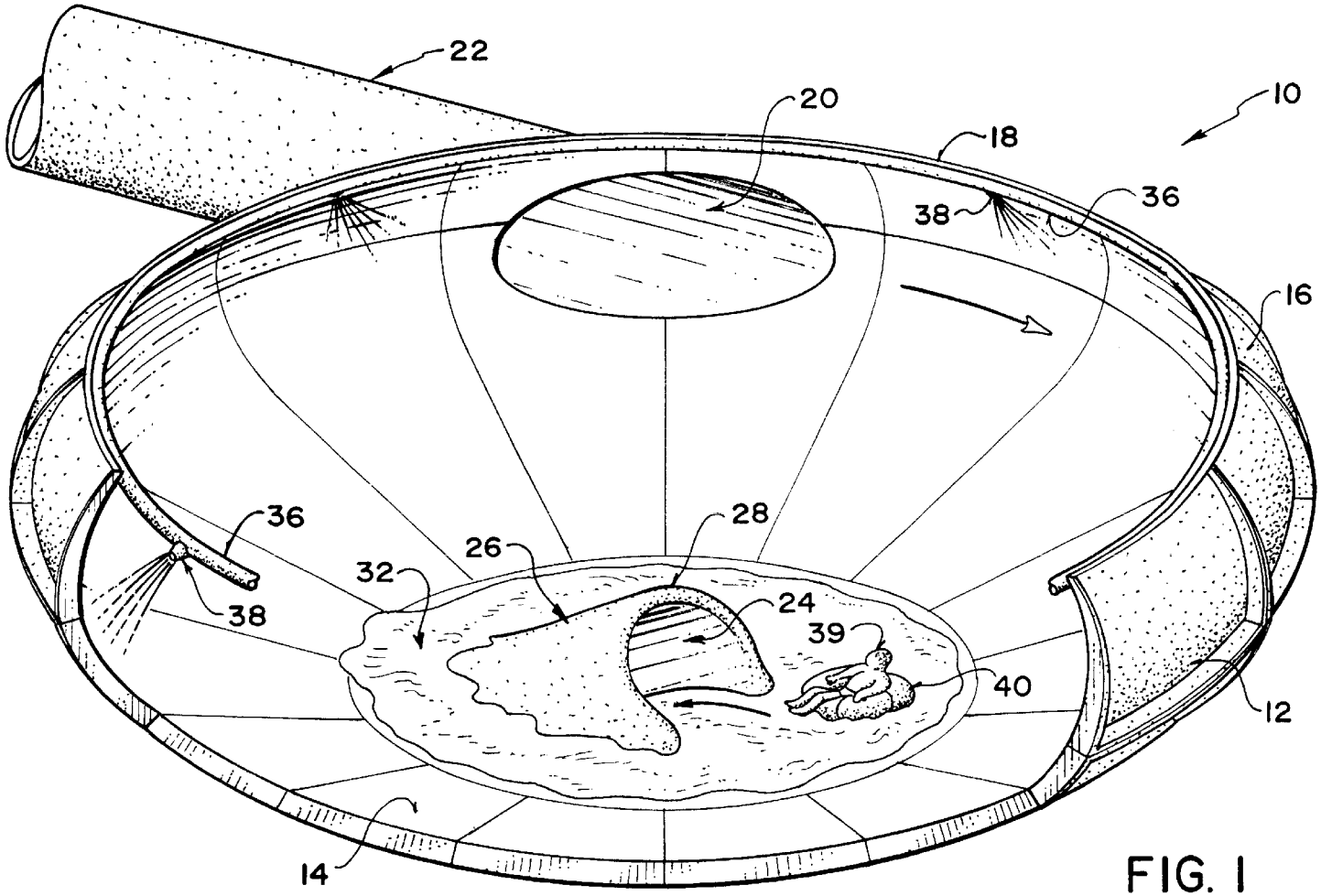
FIG. 1 is a perspective view, partly cutaway, of a waterslide bowl according to the invention.

In a preferred embodiment of the principles of the invention, waterslide bowl 10 is a bowl-shaped element which forms part of a waterslide ride apparatus having ride elements upstream, i.e. at a higher elevation, and downstream, i.e. at a lower elevation, than the bowl.

Bowl 10 has a bowl wall having side wall portion 12 and bottom wall portion 14, though it will be understood that these form a continuous, curved wall structure with no clear point of demarcation between the side and bottom wall portions. Side wall portion 12 is relatively steep and curved and includes an inwardly turning portion 16 at its rim 18. Bottom wall portion 14 is gently curved and has a shallower angle from the horizontal than the side wall portion 12.

An entry hole 20 or other suitable rider entrance is provided in the side wall portion near rim 18, through which a rider slides into bowl 10 from an inlet flume 22 leading from a higher elevation.

A rider exit opening 24 is provided in the central part of the bottom wall portion 14 of the bowl. The bottom wall a portion is shaped to extend upward relative to the surrounding part at the exit opening 24, forming a throat 26. The throat has a relatively higher part 28 and a relatively lower part 30. When the apparatus is in use, a stream of water is continuously flowing into the bowl 10, as described below, and it flows out of the bowl through the exit opening 24, at the relatively lower part 30 of the throat 26. A volume of water is held in the bottom of the bowl, forming annular ring 32 of flowing water around the throat.

Exit opening 24 is connected to exit flume 34, which leads downward from bowl 10 and forms a continuation of the waterslide ride. Flume 34 can lead to other waterslide elements downstream of the bowl, if desired.

A water pipe 36 with a plurality of jets 38 placed below the rim 18 provides a continuous supply of water to the bowl to wet its sides, thus reducing friction between the rider and the walls of the bowl. Further, water is continuously flowing into the bowl through entry flume 22, which reduces the friction and facilitates the rider sliding through flume 22. Both of these sources of water flowing into bowl 10 continually replenish the ring of water 32 in the bowl, as water flows out of the bowl through throat 26.

Figure 2:
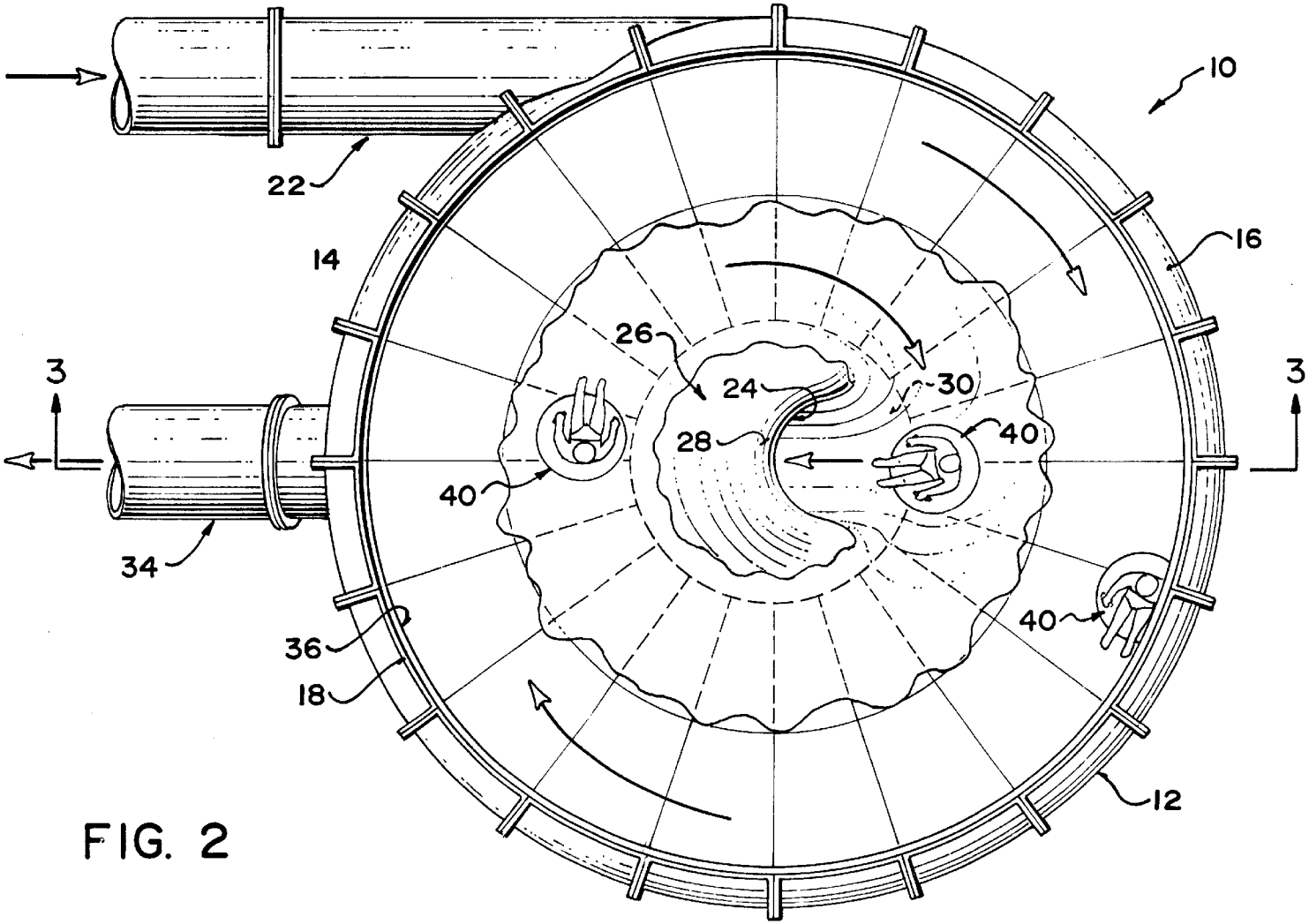
FIG. 2 is a top plan view thereof.
Figure 3:
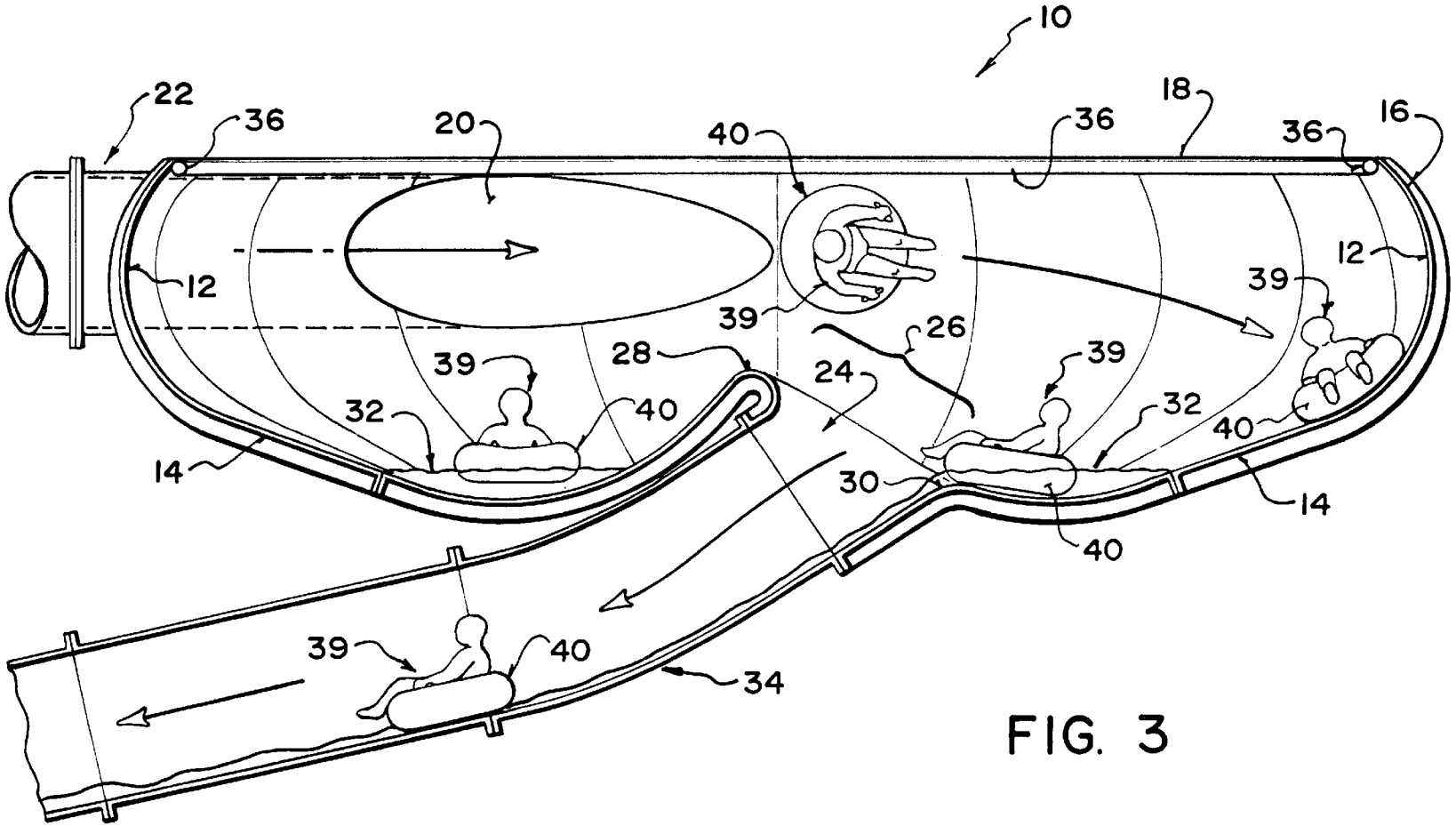
FIG. 3 is a cross-sectional view of the line 3—3 of FIG. 2.

The waterslide bowl 10 is intended particularly for use by a rider 39 on a flotation device, preferably a waterslide inner tube 40, i.e. an inflated tube or any generally doughnut-shaped flotation device. Various forms of flotation devices can be used, such as a raft or sled-shaped flotation device. It will be understood that the bowl 10 of the invention can also be ridden by a user with no flotation device. In use, a rider on an inner tube starts the waterslide ride at a higher elevation than bowl 10, rides through such other ride elements that the waterslide apparatus may have upstream of flume 22 and slides down flume 22. The flow of water through flume 22 reduces friction and provides a cushion of water supporting the rider's inner tube. The rider enters bowl 10 through entry hole 20 traveling at sufficient speed to make one or more circuits of the bowl (traveling clockwise in the view of FIG. 2) and descends gradually from the side wall portion 12 to the bottom wall portion 14 as his or her momentum decreases. The rider eventually slides into the ring of water 32, is slowed down by the water and is carried by the flow of water in the ring, and by any residual momentum, through the throat 26 and into exit flume 34, still riding on the inner tube 40. Flume 34 (and also flume 22) can be closed tube or an open channel. The waterslide ride accordingly continues, downward from bowl 10, with flume 34 and such further downstream waterslide elements that may be provided in a particular waterslide apparatus.

Bowl 10 is fabricated from a plurality of sections of a suitable and durable material, such as fiberglass, fastened together to form a strong, rigid structure. It is supported as part of a waterslide apparatus by suitable support members (not shown) extending to the ground or to other parts of the waterslide apparatus.

A liner may be applied to the inner surface to provide a continuous, smooth interior surface that will facilitate a rider's sliding movement.

The bowl preferably has a depth in the range of about 4 to 20 feet and a diameter in the range of about 20 to 60 feet. The inner diameter of flumes 22 and 34 is preferably in the range of about 2.5 to 6 feet.

The above-described preferred embodiment is intended to illustrate principles of the invention, but not to limit the scope of the invention. Various other embodiments and modifications may be made by those skilled in the art without departing from the scope of the following claims. For example, the rider entrance to the bowl can be configured in various ways, such as a cut-out at the rim of the bowl rather than hole in the side wall; or it can be positioned lower down in the wall than has been shown in the drawings. The flumes leading into and out of the bowl can be configured in various ways, so long as they fulfil the function of safely conveying the rider into and out of the bowl. The bowl can include a cover. The bowl can be made of concrete, wood, metal or other materials, with a plastic liner. The rider can use various types of raft or flotation device other than the inner tube. The shapes and gradient of the walls of the bowl can be altered to make the ride faster or slower. The bottom wall portion and throat 26 can be configured to hold a relatively larger or relatively smaller volume of water in the bowl, for example lower part 30 of throat 26 can be made only slightly higher than the lowest part of the bottom wall portion so the volume of water in ring 32 is small and the water quickly flows out of throat 26. The throat can be a separate structure affixed to the waterslide bowl, rather than being formed integrally by shaping the bottom wall portion. Also, the throat 26 can have a variety of specific contours and can be, for example, more open at the upper side thereof than is illustrated in the drawings; this would be preferred where the exit flume 34 is an open channel (i.e., U-shaped) rather than a closed tube.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A bowl adapted for use as a part of a waterslide apparatus, comprising:

a bowl wall having a side wall portion and a bottom wall portion;

a rider entrance in said side wall portion through which a rider slides into said bowl;

a rider exit opening in said bottom wall portion;

said bowl being configured to hold a volume of water around said rider exit opening; and said rider exit opening being configured to receive a flow of water from said volume of water in said bowl.

2. A waterslide comprising:

a bowl having a side wall portion and a bottom wall portion, the side wall portion and the bottom wall portion forming a continuous, curved wall structure for conveying a rider on one or more circuits of the bowl, the side wall portion having a rider entrance, and the bottom wall portion having a rider exit opening, the bottom wall portion being configured for retaining a quantity of water adjacent to the rider exit opening;

an inlet flume leading to the rider entrance from a higher elevation than the bowl for conveying a rider to the rider entrance for sliding of a rider into the bowl; and an exit flume leading away from the exit opening for conveying a rider away from the bowl.

3. A waterslide comprising:

a bowl having a side wall portion and a bottom wall portion, the side wall portion and the bottom wall portion forming a continuous, curved wall structure with no clear point of demarcation between the side wall portion and the bottom wall portion for conveying a rider on one or more circuits of the bowl, the side wall portion having a rider entrance, and the bottom wall portion having a rider exit opening, the bottom wall portion being configured for retaining a quantity of water adjacent to the rider exit opening;

an inlet flume leading to the rider entrance from a higher elevation than the bowl for conveying a rider to the rider entrance for sliding of a rider into the bowl; and an exit flume leading away from the exit opening for conveying a rider away from the bowl.

4. A waterslide comprising:

a bowl having a side wall portion and a bottom wall portion, the side wall portion and the bottom wall portion forming a continuous, curved wall structure for conveying a rider on one or more circuits of the bowl, the side wall portion having a rider entrance, and the bottom wall portion having a rider exit opening, the bottom wall portion being configured for retaining a quantity of water adjacent to the rider exit opening, the side wall portion being steep and the bottom wall portion being disposed at a shallower angle to horizontal than the side wall portion;

an inlet flume leading to the rider entrance from a higher elevation than the bowl for conveying a rider to the rider entrance for sliding of a rider into the bowl; and an exit flume leading away from the exit opening for conveying a rider away from the bowl.

5. A waterslide comprising:

a bowl having a side wall portion and a bottom wall portion, the side wall portion and the bottom wall portion forming a continuous, curved wall structure for conveying a rider on one or more circuits of the bowl, the side wall portion having a rider entrance, and the bottom wall portion having a rider exit opening, the bottom wall portion being configured for retaining an annular ring of water around the rider exit opening;

an inlet flume leading to the rider entrance from a higher elevation than the bowl for conveying a rider to the rider entrance for sliding of a rider into the bowl; and an exit flume leading away from the exit opening for conveying a rider away from the bowl.

6. A waterslide comprising:

a bowl having a side wall portion and a bottom wall portion, the side wall portion and the bottom wall portion forming a continuous, curved wall structure for conveying a rider on one or more circuits of the bowl, the side wall portion having a rider entrance, and the bottom wall portion having a rider exit opening, the bottom wall portion being configured for retaining a quantity of water adjacent to the rider exit opening, the bowl having a depth between four feet and twenty feet and a diameter between twenty feet and sixty feet;

an inlet flume leading to the rider entrance from a higher elevation than the bowl for conveying a rider to the rider entrance for sliding of a rider into the bowl; and an exit flume leading away from the exit opening for conveying a rider away from the bowl.

7. A waterslide comprising:

a bowl having a side wall portion and a bottom wall portion, the side wall portion and the bottom wall portion forming a continuous, curved wall structure for conveying a rider on one or more circuits of the bowl, the side wall portion having a rider entrance, and the bottom wall portion having a rider exit opening, the bottom wall portion being configured for retaining a quantity of water adjacent to the rider exit opening;

an inlet flume leading to the rider entrance from a higher elevation Man the bowl for conveying a stream of water and a rider to the rider entrance for sliding of a rider into the bowl; and an exit flume leading away from the exit opening for conveying water and a rider away from the bowl.

8. A waterslide comprising:

a bowl having a side wall portion and a bottom wall portion., the side wall portion and the bottom wall portion forming a continuous, curved wall structure with no clear point of demarcation between the side wall portion and the bottom wall portion for conveying a rider on one or more circuits of the bowl, the side wall portion having a rider entrance, and the bottom wall portion having a rider exit opening, the bottom wall portion being configured for retaining an annular ring of water around the rider exit opening, the side wall portion being steep and the bottom wall portion being disposed at a shallower angle to horizontal than the side wall portion, the bowl having a depth between four feet and twenty feet and a diameter between twenty feet and sixty feet;

an inlet flume leading to the rider entrance from, a higher elevation than the bowl for conveying a stream of water and a rider to the rider entrance for sliding of a rider into the bowl; and an exit flume leading away from the exit opening for conveying water and a rider away from the bowl.

* * * * *

UNITED STATES PATENT AND TRADEMARK OFFICE

CERTIFICATE OF CORRECTION

PATENT NO. : 6,485,372 B2
DATED : November 26, 2002
INVENTOR(S) : A. Stuart et al.

It is certified that error appears in the above-identified patent and that said Letters Patent is hereby corrected as shown below:

Title page,
Item [75], Inventors, "New Haven" should read -- Newhaven --; and "New Haven" should read -- Hailsham --

Column 1,
Line 25, "know" should read -- known --

Column 2,
Line 29, "bottom wall a" should read -- bottom wall --

Column 3,
Line 34, "rather than hole" should read -- rather than as a hole --

Column 6,
Line 4, "Man" should read -- than --
Line 12, "portion.," should read -- portion, --
Line 27, "from," should read -- from --

Signed and Sealed this

Eleventh Day of March, 2003

JAMES E. ROGAN
*Director of the United States Patent and Trademark Office*